United States Patent [19]

Marsh et al.

[11] 4,266,843

[45] May 12, 1981

[54] INSULATION DISPLACING ELECTRICAL CONTACT AND METHOD OF MAKING SAME

[75] Inventors: Edward K. Marsh; Dean R. Nelson, both of Sidney, N.Y.

[73] Assignee: The Bendix Corporation, Southfield, Mich.

[21] Appl. No.: 78,418

[22] Filed: Sep. 24, 1979

[51] Int. Cl.[3] ..... H01R 11/22; H01R 25/06; H01R 43/04

[52] U.S. Cl. ..... 339/97 R; 29/874; 339/47 R

[58] Field of Search ..... 339/97, 98, 276 SF, 339/99, 95, 47 R, 49 R; 29/882, 884, 881, 874

[56] References Cited

U.S. PATENT DOCUMENTS

| | | | |
|---|---|---|---|
| 3,725,844 | 4/1973 | McKeown | 339/49 R |
| 3,895,852 | 7/1975 | Wasserlein | 339/99 R |
| 4,158,745 | 6/1979 | Keller | 339/276 SF |
| 4,212,509 | 7/1980 | Brooks | 339/97 R X |

*Primary Examiner*—John McQuade
*Assistant Examiner*—John S. Brown
*Attorney, Agent, or Firm*—David R. Syrowik; Kenneth A. Seaman; Charles D. Lacina

[57] ABSTRACT

An improved insulation displacing electrical contact (14) and method of making the contact (14) is disclosed. The contact (14) comprises a holder (16), a retention sleeve (18) and brush wires (22). The holder includes a body portion (20) having an axial passage (24) extending therethrough and a head portion (28) connected to the body portion (20) by a curved interconnecting neck portion (30). The head portion (28) includes a pair of angled legs (38, 40) and an interconnecting bent portion (42). A slot (32) extends through the bent portion (42) and through the legs (38, 40). Each leg has a pair of opposing stripping surfaces (48, 50) for stripping insulation (13) from a wire cable (12) inserted through the slot (32) and each leg has a pair of opposing gripping surfaces (52, 54) for holding the stripped wire cable (12) in the slot (32). As a result, a stripping position and a gripping position are formed at each leg, the two stripping positions being spaced apart a smaller distance than the distance between the two gripping positions. The brush wires (22) are axially aligned and axially mounted within the passage (24) of the body portion (20). The retention sleeve (18) including a pair of radially deflectable retaining ears (70, 72) is telescopically positioned over the body portion (20) and crimped thereto to provide a means for retaining the assembled contact (14) within a housing passage (76).

19 Claims, 5 Drawing Figures

Fig-1
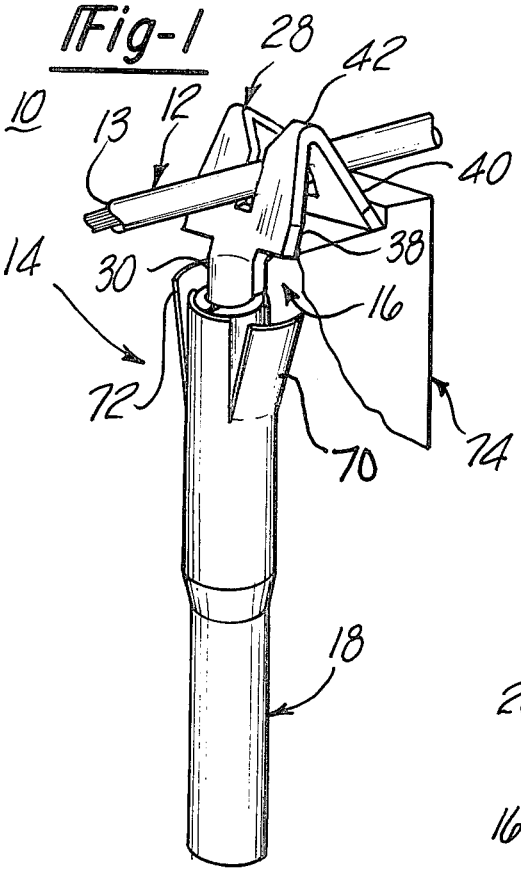
Fig-5
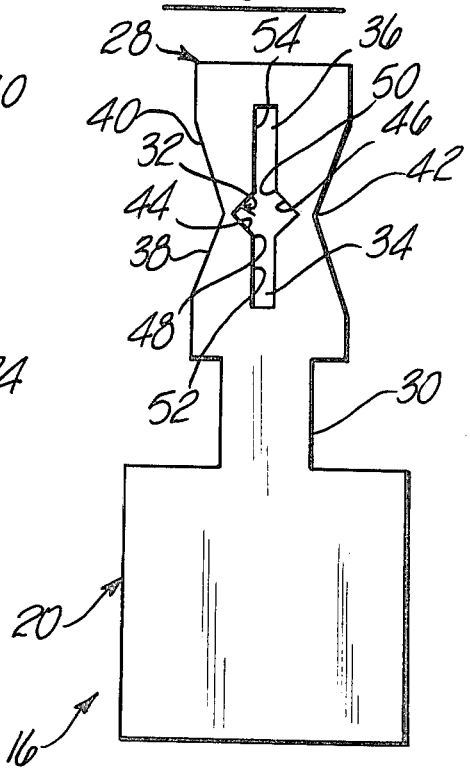
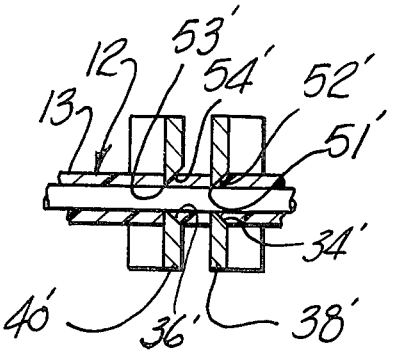
Fig-3
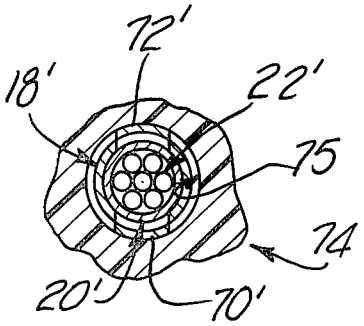
Fig-4

INSULATION DISPLACING ELECTRICAL CONTACT AND METHOD OF MAKING SAME

TECHNICAL FIELD

This invention relates to electrical connecting devices and in particular to connector assemblies including contacts for terminating wire cable and a method for making the connector assemblies and the contacts.

BACKGROUND ART

Small discrete wire cable and flat wire cable are frequently used in wiring of printed circuits and other complicated electrical and electronic systems. Because of its economy, convenience and ease of manipulation as a wiring means for electrically interconnecting spaced components, flat cable has enjoyed increased popularity in recent years. Such cables may contact a large number, upwards of 50 or more, of small wire conductors of circular cross-section per inch of width. The electrical connection to such fine discrete wire cable or flat wire cable can be accomplished by stripping and soldering, but this practice is a delicate and time-consuming operation. Such manual slitting operations must be carried out with extreme care to insure the integrity of the insulating layers after the assembly is completed.

Prior patents disclose "U"-shaped insulation displacement contacts which provide two contact surfaces. For example, the U.S. Pat. No. of Hudson, Jr. et al 4,068,912 discloses such a U-shaped insulation displacing electrical connector to affect an insulation displacing engagement of the terminal with its respective conductor. Other prior patents disclose insulation displacement contacts which provide four points of contact or four contact surfaces to provide mating electrical engagement between conductive elements such as a flat cable. For example, the U.S. Pat. No. of Narozny, 3,990,767 discloses a tubular segment having sharpened edges at its free end which edges are used to pierce insulation and engage a conductor. Likewise, the U.S. Pat. No. of Huber 3,864,011 discloses two cantilever torsion bar L-shaped slotted terminals 80 and 82 which comprise contact terminals.

A common problem associated with the termination of such cable and wires is that the cable or wires may be inadvertently disengaged from their respective contacts either partially or totally.

Other electrical contacts of the type to which this invention relates are disclosed by the U.S. Pat. Nos. of Campbell et al 3,912,354 and Thelissen 4,025,141 and U.S. patent application entitled "Electrical Connector" having U.S. Ser. No. 874,451; filed in February of 1978 and assigned to the assignee of the present invention.

DISCLOSURE OF THE INVENTION

An object of the present invention is to provide an improved electrical contact and method of making same.

It is another object of this invention to provide an electrical contact for electrically interconnecting an insulated wire cable to an electrical connector.

Yet another object of the present invention is to provide an electrical contact which provides an efficient means of terminating cable wire having an insulation layer while providing a low insertion force connector.

Yet another object of the present invention is to provide an insulation displacement electrical contact which exerts an axial force on the held wire between complementary pairs of contact points to, in turn, provide good wire retention.

In carrying out the above objects and other objects of this invention a preferred embodiment of an electrical contact constructed in accordance with the invention comprises a holder (16) including an elongated electrical conductor portion (20) having an axial passage (24) and a flange portion (28) connected to the conductor portion (20) in electric circuit relationship. The flange portion (28) has a slot (32) extending therethrough and has two pairs of opposing stripping surfaces (48,50) defining the slot (32) for stripping insulation (13) from an electrical wire (12) inserted through the slot (32) at two stripping positions spaced apart a first distance. The flange portion (28) has two pairs of opposing gripping surfaces (52, 54) further defining the slot (32) for holding the stripped wire (12) in a slot (32) at two holding positions spaced apart a second distance different than the first distance in electric circuit relationship with the flange portion (28). The electrical contact also comprises electrical conducting wires (22) axially aligned and axially mounted within the passage of the conductor portion (20), each of the wires (22) including an end portion (26) that terminates in an acutely angled surface.

In carrying out the above objects and other objects of this invention, a preferred method of making a holder for an electrical contact includes the step of cutting a slot through the head portion of a flat conductive sheet having an elongated body portion and a neck portion interconnecting the head portion and the body portion; forming the flat body portion into a tubular form having an axially extending passage and an axially extending seam; and, bending the head portion about the slot so that two aligned slits and a communicating aperture are formed.

The objects, features and advantages of the present invention are readily apparent from the following detailed description of the best mode taken in connection with the accompanying drawings.

BRIEF DESCRIPTION OF THE DRAWINGS

FIG. 1 is a perspective view partially broken away, which shows an electrical connector assembly constructed according to the invention;

FIG. 3 is a view taken along the line 3—3 of FIG. 2;

FIG. 4 is a view taken along the line 4—4 of FIG. 2; and

FIG. 5 is a planar view of the holder of the contact in its flat blank form before it is shaped.

BEST MODE FOR CARRYING OUT THE INVENTION

Figure 2:
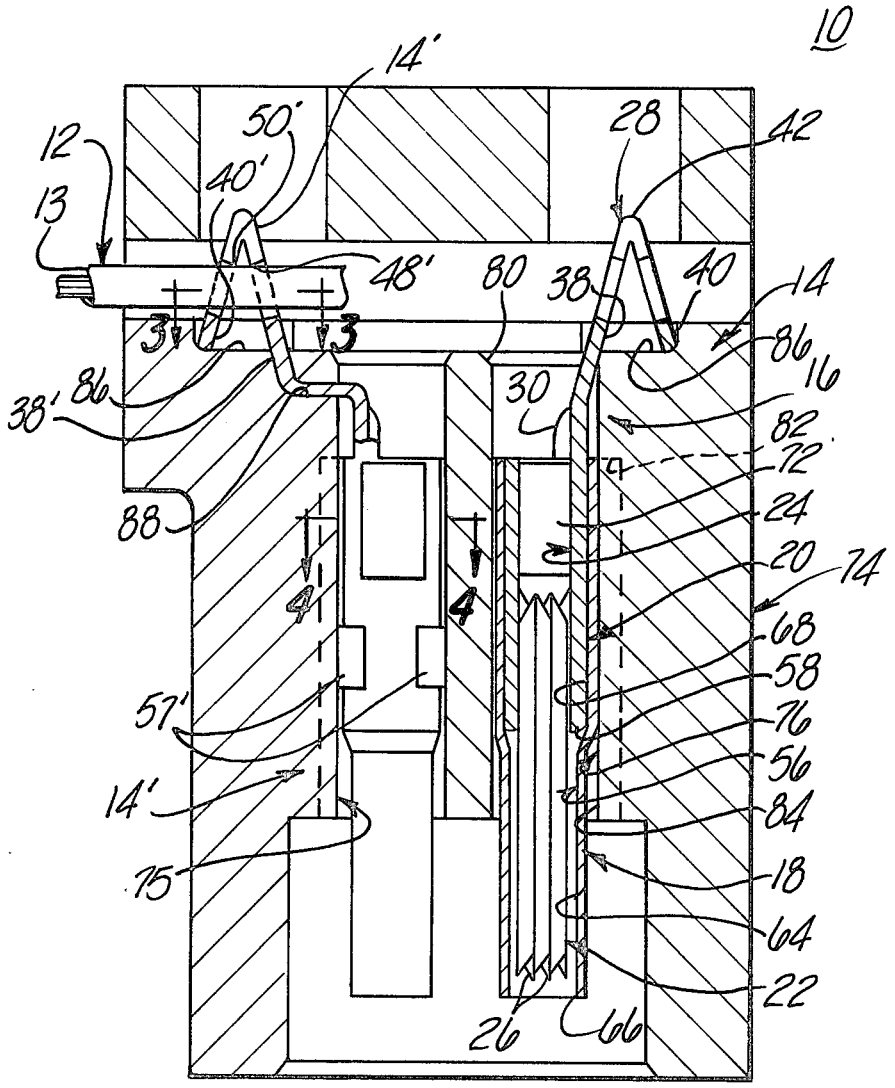
FIG. 2 is a sectional view of a pair of electrical contacts of a connector assembly holding a wire cable.

Referring to FIG. 1 an electrical connector assembly constructed according to the present invention is indicated collectively by reference numeral 10. The assembly 10 is adapted to mate with or terminate insulated conductors such as the discrete wire cable 12 or flat wire cable by first stripping the insulation 13 from the cable 12 and then holding the cable 12 at its stripped portion as shown in FIG. 3.

The assembly 10 includes an electrical contact generally indicated at 14 which preferably comprises three elements including a contact holder generally indicated at 16, an elongated body comprising a conductive retention sleeve generally indicated at 18 and a brush wire bundle 22 (FIG. 2). The sleeve 18 is telescoped over an elongated electrical conductor portion or tubular body portion generally indicated at 20 of the holder 16. The brush wire bundle 22 comprises several electrical conducting brush wires in FIG. 2 which are axially aligned and axially mounted within an axial passage 24 which extends completely through the tubular body portion 20 of the holder 16. Each of the wires 22 includes an end portion 26 that terminates in an acutely angled surface which is preferably 30 degrees, although greater or lesser angles could be used advantageously to practice the present invention.

Referring to FIG. 2 a pair of substantially identical contacts 14 and 14' are shown. Therefore, unless specifically noted, the description of one of the contacts 14, 14' holds true for the other contact.

The fine wires 22 of the present invention make up a bundle which is generally disclosed in United States patent to McKeown et al for "Hermaphroditic Electrical Contact", U.S. Pat. No. 3,725,844 issued Apr. 3, 1973 which is hereby incorporated herein by reference. In one embodiment of the invention seven strands of beryllium copper wire each having a diameter of approximately 0.008 inches each are used although other materials, sizes of wires or strand count could be substituted without departing from the spirit of the present invention.

The contact holder 16 also includes a flange or head portion generally indicated at 28 which is integrally formed, together with an interconnecting curved connector or neck portion 30 and the body portion 20, from a single flat sheet of beryllium copper or other suitable material from which a flat blank is cut or stamped as shown in FIG. 5 and then formed into the shape as shown in FIGS. 1 and 2 as described in greater detail hereinafter.

The head portion 28 has a slot generally indicated at 32 extending completely therethrough. The slot 32 includes a pair of substantially identical slits 34 and 36 which are formed through a pair of angled legs 38 and 40, respectively, of the head portion 28 as shown in FIGS. 1 and 2. The legs 38 and 40 are integrally formed with an interconnecting bent portion 42. The bent portion interconnects the two legs on opposite sides of the slot 32.

As best shown in FIG. 5 each of the legs 38 and 40 includes a pair of opposing guiding surfaces 44 and 46, respectively, for guiding inserted cable into the slot 32 and which define a portion of the slot 32. The surfaces 44 and 46 are tapered inwardly to two pairs of stripping surfaces 48 and 50 which strip the insulation 13 from the cable 12 as the cable 12 is pushed between the opposing pairs of angled stripping surfaces 48 and 50 as best shown in FIGS. 1 and 2. As used herein, strip or stripping a wire is defined as the process or method of cutting through and displacing the electrical insulation surrounding an electrically conductive wire.

As best shown in FIG. 3, as the stripped portions of the cable 12 are further pushed into the slits 34' and 36', pairs of angled gripping surfaces 52' and 54', which further define the slits 34' and 36', respectively, mechanically deform the stripped portions of the cable 12 and grip or hold the stripped cable 12 in the slits 34' and 36' at a pair of spaced holding positions 51' and 53'. Because the legs 38' and 40' are angularly formed with respect to each other the cable 12 is stretched or placed under tension as it is being pushed into the slits 34' and 36', after the insulation 13 has been stripped at the more closely spaced stripping surfaces 48' and 50'. A secure mechanical electrical connection is thereby provided between the cable 12 and the head portion 28' of the contact 14' at four contact points to further provide a low termination resistance.

Referring to FIG. 2, the retention sleeve 18 has an axial passage generally indicated at 56 which extends completely therethrough. The body portion 20 of the holder 16 is axially aligned and axially mounted within the passage 56 of the sleeve 18 such as by crimping at a crimp joint similar to a crimp joint 57' of the contact 14' so that the sleeve 18 extends beyond an end 58 of the body portion 20 and beyond the end portions 26 of the wires 22. The wires 22 are preferably crimped within the axial passage 24 of the body portion 20 at the same time the sleeve 18 is crimped to the body portion 20 at the crimp joint of the contact 18. In other words, the sleeve 18 is secured to the body portion 20 of the holder 16 and the brush wires 22 to the body portion 20 of the holder 16 in one crimping step will be described in greater detail hereinafter.

Referring to FIG. 2, the axial passage 56 of the sleeve 18 includes an end portion 64 that terminates in an opening 66 at the end of the sleeve 18 and further includes an interior passage portion 68 within which the body portion 20 of the holder 16 is aligned. The end portion 64 of the passage 56 has a cross-sectional area smaller than the cross-sectional area of the interior portion 68 of the passage 56. However, the cross-sectional area of the end portion 64 of the passage 56 is large enough to allow the spreading of the wires 22 in a radial direction when similar wires (not shown) are inserted through the opening 66 of the passage 56 thereby allowing the wires to intermingle and establish an electrical circuit relationship between the two assemblies.

The sleeve 18 has at least one and preferably two lanced or slit axially extending retention ears 70 and 72 integrally formed therewith. The assembly 10 includes a housing generally indicated at 74 of dielectric material having a pair of axial passages generally indicated at 75 and 76 extending therethrough to receive the contacts 14 and 14' therein. When the contact 14 as shown in FIG. 1 is inserted into a chamfered top opening 80 of the passage 76, the retention ears 70 and 72 are deflected radially inwardly. As the contact 10 is further inserted into the passage 76 to the position substantially shown in FIG. 2 the retention ears 70 and 72 deflect radially outwardly and engage a shoulder portion 82 of the housing 74 to prevent movement of the contact 14 out through the opening 80.

The dielectric housing 74 may comprise a thermoplastic resin although other materials may also be used such as those described in U.S. Pat. No. 4,082,398 having the same assignee as the present application and which patent is hereby incorporated herein by reference.

The contact 14 may be removed through the opening 80 of the housing 74 by a suitable tool (not shown) inserted in the opposite end portion 84 of the passage 76 to deflect the retention ears 70 and 72 away from engagement with the shoulder portion 82 of the housing 74.

The housing 74 also includes a second shoulder portion 86 for supporting the legs 40 and 40' and also includes a third shoulder portion 88 for supporting the other leg 38' of the contact 14' thereon.

FIGS. 2 and 5 illustrate the steps associated with stamping and forming of the holder 16 of the present invention. Initially, the overall shape of the holder 16 is stamped out and the slot 32 is stamped out of a flat sheet of beryllium copper metal. The head portion may then be bent to form substantially identical complementary halves of the slot 32 in each of the legs 38 and 40. The body portion 20 and the neck portion 30 are rolled or formed into their corresponding shapes. Thereafter, the body portion 20 is positioned on a locating pin (not shown) and the wires 22 are inserted into the passage 24 until the ends 90 of the wires 22 engage the locating pin. The retention ears 70 and 72 of the sleeve 18 are formed by slitting or cutting. The sleeve 18 is slid over the body portion 20 until the end 58 of the body portion 20 engages the portion of the sleeve 18 having a reduced diameter. Thereafter, the sleeve 18 is secured to the body portion 20 and the brush wires 22 are secured to the body portion 20 by crimping the entire contact together at the crimp joint of the contact 14 in one operation as is well known in the art.

In manufacturing the contact 14, the sleeve 18 is preferably drawn from tube stock of phosphor bronze or other suitable material.

While a preferred embodiment of the contact, the electrical connector assembly and methods of making the electrical contact and the connector assembly have been described herein in detail, those skilled in the art will recognize various alternative designs and embodiments for practicing the present invention as defined by the following claims.

What is claimed is:

1. An electrical contact adapted for mating with an insulated electrical wire comprising:

an elongated body having an axial passage extending completely therethrough;

a holder including, an elongated electrical conductor portion having an axial passage, and a flanged portion connected to the conductor portion in electric circuit relationship, said flanged portion having a slot extending therethrough and having two pairs of opposing stripping surfaces defining said slot for stripping insulation from an electrical wire inserted through said slot at two stripping positions spaced apart a first distance and having two pairs of opposing gripping surfaces further defining said slot for holding the stripped wire in said slot at two holding positions spaced apart a second distance different than the first distance in electric circuit relationship with said flanged portion; and electrical conducting wires axially aligned and axially mounted within the passage of said conductor portion, each of said wires including an end portion that terminates in an acutely angled surface, said conductor portion being axially aligned and axially mounted within the passage of the body so that the body extends beyond the end of the conductor portion opposite the flanged portion and beyond the ends of said wires.

2. The contact as defined in claim 1 wherein said flange portion includes a pair of angled legs and an interconnecting bent portion, said slot extending through said bent portion and through said legs, each leg having one of said pairs of opposing stripping surfaces and one of said pairs of opposing gripping surfaces.

3. The contact as defined in claim 2 wherein said flange portion includes a curved connector portion integral with the flange portion and the conductor portion to connect an end portion of said conductor portion to the end portion of one of said legs.

4. The contact as defined in claim 2 wherein each leg has a pair of opposing receiving surfaces further defining said slot and tapered from said bent portion to said stripping surfaces and wherein said first distance is less than said second distance.

5. The contact as defined in claim 4 wherein each stripping surface is formed immediately adjacent a gripping surface of each of said legs to form a continuous surface.

6. The contact as defined in claim 1 wherein said body comprises an electrical conductor and wherein said contact further includes retaining means integrally connected to said conductor and adapted for securing said contact to a housing.

7. The contact as defined in claim 6 wherein said retaining means comprises at least one radially deflectable retaining ear axially extending at one end of said conductor.

8. The contact as defined in claim 7 wherein the axial passage of said conductor includes an end portion that terminates in an opening, the end portion of said conductor axial passage having a cross-sectional area smaller than the cross-sectional area of the interior portion of the conductor axial passage.

9. An electrical connector assembly adapted for mating with at least one other electrical connector assembly and adapted for mating an insulated electrical wire comprising:

a housing having at least one passage therethrough;

an elongated body having an axial passage extending completely therethrough;

at least one holder having, an elongated electrical conductor portion mounted in the housing passage and having an axial passage, and a flanged portion connected to the conductor portion in electric circuit relationship, said flanged portion having a slot extending therethrough defined by two pairs of opposing stripping surfaces for stripping the insulation from an electrical wire inserted through said slot at two stripping positions spaced apart a first distance and having two pairs of opposing gripping surfaces further defining said slot for holding the stripped wire in said slot at two holding positions spaced apart a second distance in electric circuit relationship with said flanged portion; and several electrical conducting wires axially aligned and axially mounted within the passage of said conductor portion, each of said wires including an end portion that terminates in an acutely angled surface, said conductor portion being axially aligned and axially mounted within the passage of the body so that the body extends beyond the end of the conductor portion opposite the flanged portion and beyond the ends of the wires.

10. The assembly as defined in claim 9 wherein said flange portion includes a pair of angled legs and an interconnecting bent portion, the slot extending through the bent portion and the legs, each leg having one of said pairs of the opposing stripping surfaces and one of said pairs of opposing gripping surfaces.

11. The assembly as defined in claim 10 wherein each leg has a pair of opposing receiving surfaces further defining said slot and tapered from said bent portion to said stripping surfaces and wherein said first distance is less than said second distance.

12. The assembly as defined in claim 10 wherein said flange portion includes a curved connector portion integral with the flange portion and the conductor portion to connect an end portion of said conductor portion to the end portion of one of said legs.

13. The assembly as defined in claim 12 wherein said housing includes a first shoulder portion for supporting one of the legs thereon.

14. The assembly as defined in claim 13 wherein said housing includes a second shoulder portion for supporting the other leg thereon.

15. The assembly as defined in claim 9 wherein said body comprises an electrical conductor and wherein said contact further includes retaining means integrally connected to said conductor for securing the contact within the housing passage.

16. The assembly as defined in claim 15 wherein said retaining means comprises at least one radially deflectable retaining ear axially extending at one end of said conductor and wherein said housing includes a shoulder portion, said retaining means engaging the shoulder portion to retain the contact within the housing passage.

17. A method of making a holder for an electrical contact, the steps of the method comprising:

cutting a slot through the head portion of a flat conductive sheet having an elongated body portion and a neck portion interconnecting the head portion and the body portion, forming the flat body portion into a tubular form having an axially extending passage and an axially extending seam bending the head portion about the slot so that two aligned slits and a communicating aperture are formed, forming axially extending slits in one end portion of a sleeve to form at least one radially deflectable retaining ear, sliding the sleeve over the tubular form, and securing the sleeve and the tubular form together.

18. The method as defined in claim 14 wherein the step of inserting occurs before the step of sliding.

19. A method of making an electrical contact, the steps of the method comprising:

cutting a slot through the head portion of a flat conductive sheet having an elongated body portion and a neck portion interconnecting the head portion of the body portion, forming the flat body portion into a tubular form having an axially extending passage and an axially extending seam, bending the head portion about the slot so that two aligned slits and a communicating aperture are formed, positioning the tubular form, inserting axially aligned electrical conducting wires into the passage, securing the wires in the body portion to form an electrical and mechanical connection therebetween, forming axially extending slits in one end portion of a sleeve to form at least one radially deflectable retaining year, sliding the sleeve over the tubular form, and securing the wires and the sleeves and the tubular form together.

* * * * *